US005895873A

United States Patent [19]

Yanagisawa

[11] Patent Number: 5,895,873

[45] Date of Patent: Apr. 20, 1999

[54] SNARE RIM DESIGN FOR PROLONGED SNARE WIRE LIFE

[75] Inventor: Mitsuo Yanagisawa, Yachio, Japan

[73] Assignee: Pearl Musical Instrument Co., Yachio, Japan

[21] Appl. No.: 08/844,919

[22] Filed: Apr. 22, 1997

[51] Int. Cl.[6] ..... G10D 13/02

[52] U.S. Cl. ..... 84/415

[58] Field of Search ..... 84/415, 413

[56] References Cited

U.S. PATENT DOCUMENTS 4,119,007 10/1978 Criglar et al. ..... 84/730

5,559,296 9/1996 Yamashita ..... 84/415

*Primary Examiner*—William M. Shoop, Jr.

*Assistant Examiner*—Shih-yung Hsieh

*Attorney, Agent, or Firm*—Longarce & White

[57] ABSTRACT

A snare drum design attaches snare string(s) in a manner to protect the snare string(s) from damage at the snare gate. More particularly, the snare drum design prolongs the useful life of snare strings by providing a friction resistance member along an inner periphery of a snare gate formed in the snare rim.

10 Claims, 2 Drawing Sheets

SNARE RIM DESIGN FOR PROLONGED SNARE WIRE LIFE

BACKGROUND OF THE INVENTION a) Field of the Invention

The present invention relates to snare drums, and particularly to a mechanism and design for attaching snare wire(s) in a manner to protect the snare wire(s) from damage. More particularly, the present invention provides a snare drum design which prolongs the useful life of snare wires by reducing frictional resistance on the snare wires.

b) Description of Related Art

Snare drums are percussion instruments having several gut, nylon, wire or wire-covered silk strings, called snares, stretched across the lower, or snare, head. The snares vibrate sympathetically with the lower head to which vibration is transmitted from the upper or batter head by air vibrations inside the drum. Vibrations of the snares cause a snappy, penetrating relatively high-pitched sound. The modern snare drum has a cylindrical shell of wood, plywood, or metal 3.5–12 inches high and 10–16 inches in diameter. Deeper models called field or guard's pattern drums are used in many military bands. The heads, beaten with two tapered wooden sticks ending in small knobs, are of calfskin or plastic. They are held in place by a flesh hoop around which the membrane is lapped and a counterhoop. Membrane tensioning is by screws that act independently on each head by metal rods, or, now chiefly in military bands, by rope lacings.

In conventional snare drums, a strainer 40 is mounted to the drum shell for applying strain or tension to snare string 28, or releasing tension and allowing snare string 28 to fall away from the snare head 18. The snare string 28 typically extend from the strainer through a snare gate formed with at least one aperture 30 passing through the snare rim 22. See FIG. 1 for an illustration of the major components of a snare drum.

Conventional snare drums however suffer from deterioration of the snare string 28 as a result of wear on the snare gate or the apertures 30. Tension causes unwanted wear and eventual failure of the snare string 28. This unwanted wear is magnified by the constant adjustment of the snare tension by the strainer 40.

The need therefore exists for a snare drum design which reduces or eliminates this unwanted wear on the snare string 28, and particular for a snare gate design which does not negatively impact the snares during use.

SUMMARY OF THE INVENTION

According to the present invention, a snare drum is designed to reduce or eliminate frictional wear on or fraying of the snare string passing through the aperture on the snare rim. In the preferred embodiment of the invention, a snare gate is provided with eyelets or grommets which contact the snare string at their bending point on the bottom of the snare drum when tension is applied by the strainer(s).

DETAILED DESCRIPTION OF THE PREFERRED EMBODIMENT

Figure 1:
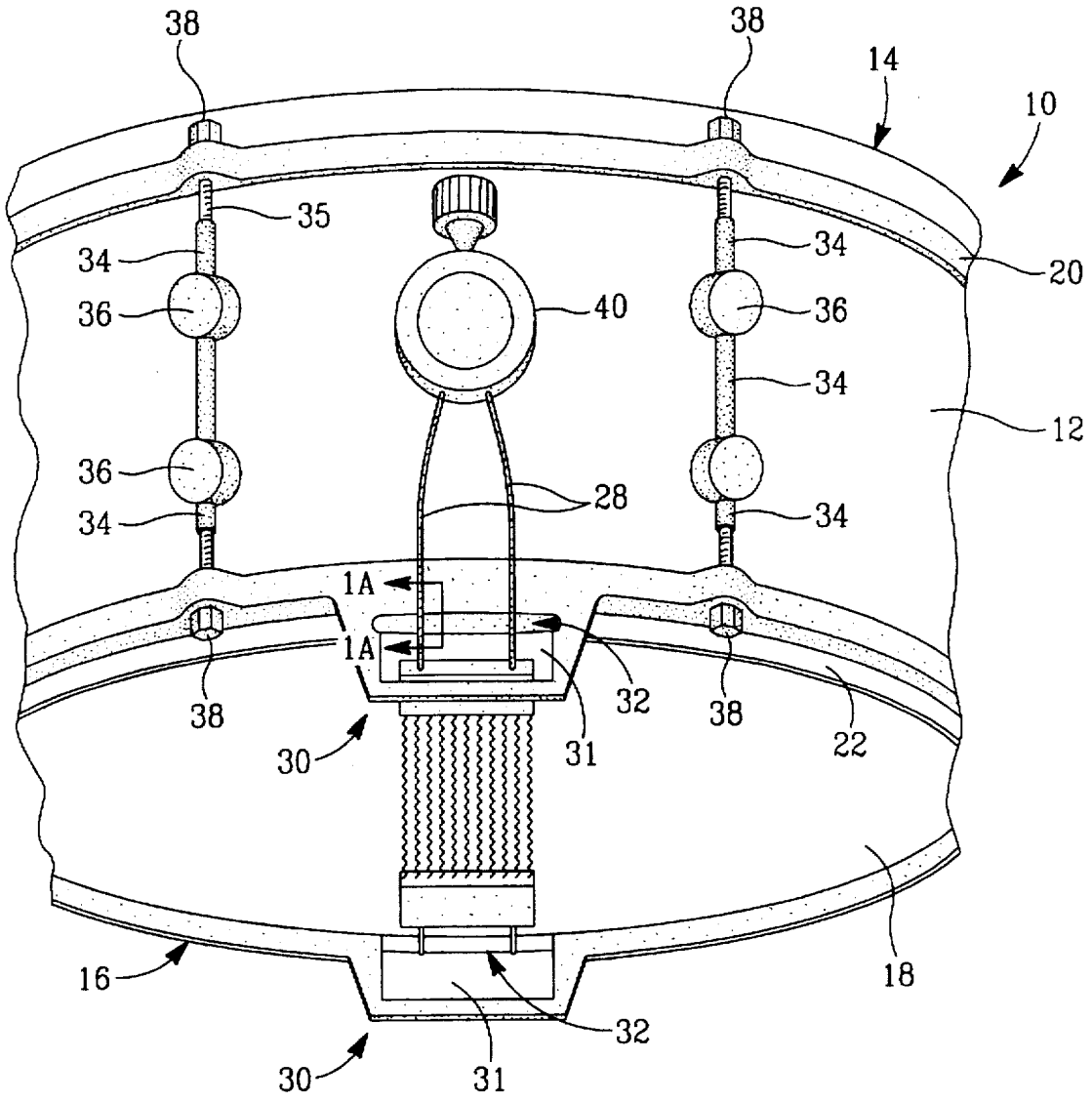
FIG. 1 is a perspective view of a snare drum showing most of the major components of a snare drum.
Figure 1A:
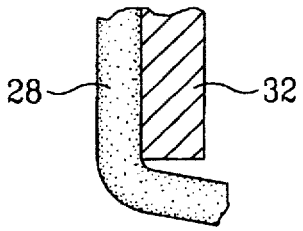
FIG. 1A is a partial cross sectional view taken along lines 1A—1A of FIG. 1.

A snare drum 10 as shown in FIG. 1 includes a shell 12 having a batter end 14 and snare end 16. A batter head (not shown) is attached to the batter end 14 by batter rim 20. Snare head 18 is attached to the snare end 16 by snare rim 22. Batter rim 20 and snare rim 22 are pulled together by a system of integrally formed elements consisting of tension rods 34, nuts 38 with square heads that can be tensioned by a drum key, and tension rod receivers 36. Tension rods 34 are aligned and held in place by tension rod receivers 36 which are typically attached to the drum shell 12. Rims 20 and 22 are positioned over their respective ends 14 and 16 so that tension rods 34 aligned with tension rod receiving apertures 35 formed in rims 20, 22. Tension rods 34 pass through the apertures 35. Nuts 38 are formed as part of the tension rods 34 pulling rims 20, 22 together, thereby fastening the batter head and snare head to batter end 14 and snare end 16, respectively.

The snare rim 22 is formed to include a snare gate 30 having at least one aperture 31 through which pass the strings or braids 28 that hold the snares 29. The snares 29 typically consist of multiple parallel strands of gut string or coiled metal wires (snappy wire), a metal retainer 28*a* at each end of each of the snare elements 29, and strings or braid 28 for each metal retainer 28*a* whereby each metal retainer 28*a* is connected to the drum body 12 via the corresponding snare strainer 40.

Significant to the present invention is the wear-reducing member 32 provided on the inner edge of the aperture(s) 31. FIG. 1 illustrates a wear reducing member in the form of an elongated pad 32 provided on the top edge which engages the strings 28 when tension is applied by the strainer 40. The wear reducing member provided on the inner edge of the aperture 31 permits a substantially othogonal turn in the snare string when connected under tension between the snares and the snare strainer.

Figure 2:
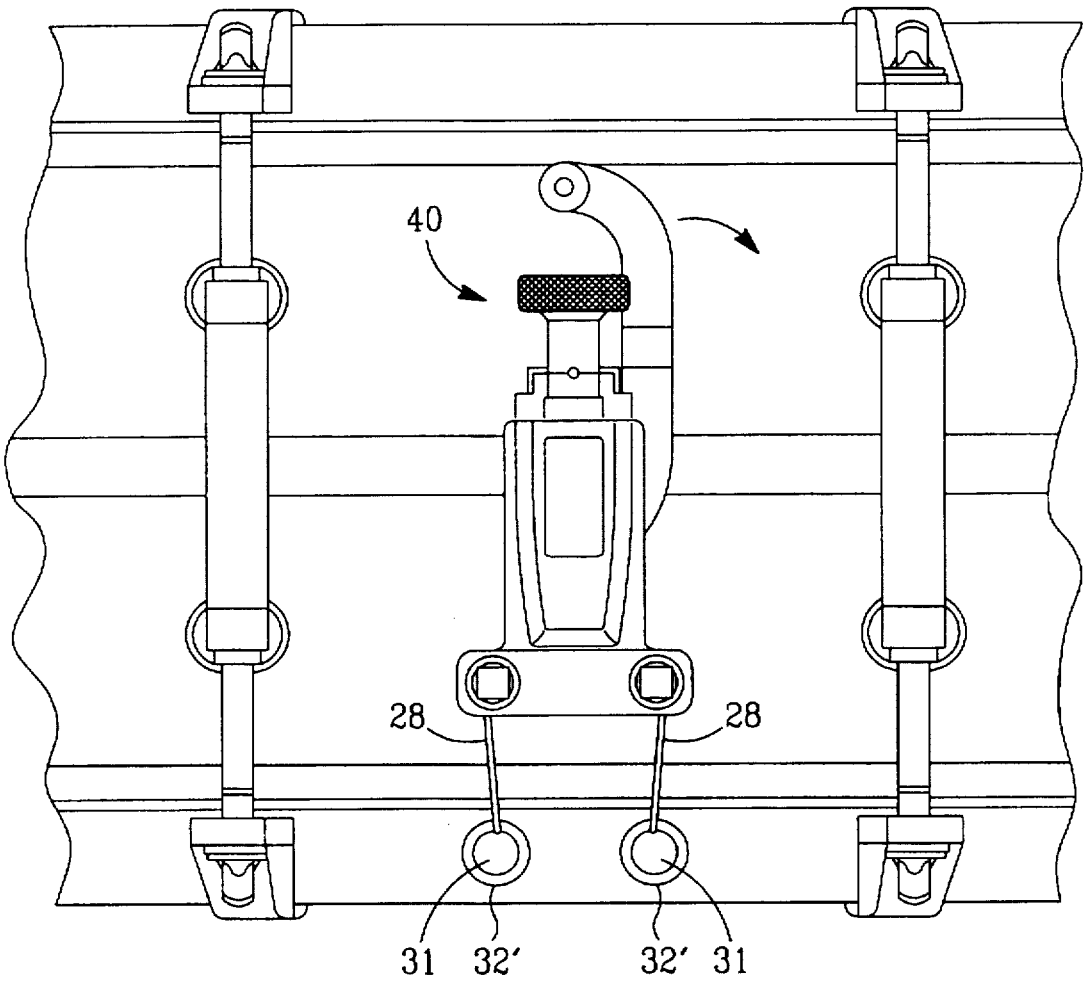
FIG. 2 is a partial view of the strainer, snare string and a snare gate showing the wear reducing elements of the present invention.

FIG. 2 also illustrates a preferred embodiment of this invention wherein a pair of apertures 31 are formed in the snare rim 22, and each aperture 31 is provided with an eyelet or grommet 32' for reducing wear on the strings 28. It should be noted that the eyelets or grommets 32' are formed with a rounded wear-reducing shape to thereby reduce frictional resistance on the wires 28 caused by the angle of curvature as the wires 28 wrap around the snare rim 22 and extend to the opposite snare gate formed in the snare rim 22.

In the preferred embodiment, the grommet 32' is formed of stainless steel, aluminum or other material which is easily formed to reduce friction and wear on the snare string that pass through the snare gate. For example, the contact edge of the aperture 31 may be coated with Teflon® of other wear-reducing material.

While the foregoing invention has been shown and described with respect to preferred embodiments, it will be understood by those possessing skill in the art that various changes in form and detail may be made to the present invention without departing from the spirit and scope of the invention.

I claim:

1. A snare drum assembly for reducing deterioration of snare strings tensioned on a snare drum, said assembly comprising:

a drum shell having a batter end and a snare end opposite said batter end;

a batter head attached to said batter end;

a snare head attached to said snare end;

snares overlying said snare head;

at least one snare string extending from said snares;

a strainer for applying tension to said snares through said snare string, said strainer mounted to an external side surface of said drum shell substantially orthogonal to said snare head;

a snare rim mounted about said drum shell adjacent said snare head, said snare rim having at least one aperture for receiving said snare string;

wherein said snare string extends from said strainer through said at least one aperture to said snares thereby permitting a substantially orthogonal turn in said snare string when connected under tension to said snares and said snare strainer;

and wherein an inner edge portion of said at least one aperture is provided with a wear-resistant member to reduce frictional resistance upon said snare string and inhibit wear of said snare rim and said snare string.

2. The snare drum assembly of claim 1, wherein said wear-resistant member comprises a grommet fitted in said at least one aperture.

3. The snare drum assembly of claim 2, wherein said grommet is formed as an annular ring circumscribing an inner periphery of said at least one aperture.

4. The snare drum assembly of claim 1, wherein said snare drum comprises a plurality of apertures for receiving a plurality of said snare strings.

5. A snare gate for reducing deterioration of snare strings tensioned on a snare drum, said snare drum comprising a drum shell, a snare rim and snare head attached to said shell, snares overlying said snare head, a strainer for applying tension to said snares, and at least one snare string connecting said snares to said strainer, said snare gate comprising:

at least one aperture formed in said snare rim through which passes said at least one snare string, said snare string extending from said strainer through said at least one aperture and to said snares;

a wear resistant member disposed on an inner edge of said at least one aperture thereby permitting a substantially orthogonal turn in said snare string when connected to said snares and said snare strainer, said wear-resistant member being formed to reduce frictional resistance upon said snare string and reduce wear of said snare string and said snare rim.

6. The snare gate according to claim 5, wherein said wear-resistant member comprises a grommet fitted in said at least one aperture.

7. The snare gate according to claim 6, wherein said grommet is formed as an annular ring circumscribing an inner periphery of said at least one aperture.

8. The snare gate according to claim 5, wherein said wear-resistant member comprises a low friction surface coating disposed on at least one inner edge of said at least one aperture.

9. The snare gate according to claim 5, wherein said snare rim comprises a plurality of apertures for receiving a plurality of said snare strings.

10. The snare gate according to claim 5, wherein said wear-resistant member extends along a single edge of each said aperture.

* * * * *